US010518426B1

(12) United States Patent
Riel

(10) Patent No.: US 10,518,426 B1
(45) Date of Patent: Dec. 31, 2019

(54) FOLDING KNIFE WITH A COMBINATION BOTTLE OPENER AND ACTUATION EXTENSION

(71) Applicant: Benjamin J. Riel, Waupun, WI (US)

(72) Inventor: Benjamin J. Riel, Waupun, WI (US)

( * ) Notice: Subject to any disclaimer, the term of this patent is extended or adjusted under 35 U.S.C. 154(b) by 138 days.

(21) Appl. No.: 15/705,316

(22) Filed: Sep. 15, 2017

(51) Int. Cl.

| | |
|---|---|
| ***B26B 11/00*** | (2006.01) |
| ***B67B 7/16*** | (2006.01) |
| ***B26B 1/02*** | (2006.01) |
| ***B25B 15/00*** | (2006.01) |

(52) U.S. Cl.
CPC ..... *B26B 11/00* (2013.01); *B25B 15/008* (2013.01); *B26B 1/02* (2013.01); *B67B 7/16* (2013.01)

(58) Field of Classification Search
CPC . B25B 15/001; B25F 1/00; B26B 1/02; B67B 7/16; B67B 7/44; B67B 11/00
See application file for complete search history.

(56) References Cited

U.S. PATENT DOCUMENTS

| | | | | |
|---|---|---|---|---|
| 964,558 | A | 7/1910 | Rose | |
| 1,513,507 | A * | 10/1924 | Hopkins | B67B 7/44 30/438 |
| 2,327,090 | A * | 8/1943 | Berg | B26B 1/02 30/159 |
| 3,088,203 | A * | 5/1963 | Perl | B67B 7/44 30/428 |
| 6,223,372 | B1 * | 5/2001 | Barber | B25F 1/00 7/118 |
| 8,402,662 | B1 * | 3/2013 | Douzanis | B26B 29/02 30/158 |
| 8,695,138 | B2 | 4/2014 | Pelton | |
| 2006/0288829 | A1 * | 12/2006 | Sipperly | B25F 1/00 83/13 |
| 2010/0077890 | A1 * | 4/2010 | Neiser | B25C 11/00 81/3.09 |
| 2017/0043467 | A1 * | 2/2017 | Arakelian | B26B 11/00 |
| 2018/0186616 | A1 * | 7/2018 | Lippert | B67B 7/0423 |

FOREIGN PATENT DOCUMENTS

| | | |
|---|---|---|
| CN | 203221521 | 10/2013 |

* cited by examiner

*Primary Examiner* — Monica S Carter
*Assistant Examiner* — Marcel T Dion
(74) *Attorney, Agent, or Firm* — Donald J. Ersler

(57) ABSTRACT

A folding knife with a combination bottle opener and actuation extension preferably includes a bottle opening member and a fastener. The bottle opening member includes a base member a first extended leg and a second extended leg. The first extended leg extends from one side of the base member at a top of the base member. The second extended leg extends from the one side of the base member at a bottom of the base member. The second extended leg extends outward and upward from the base member. A retention hole is formed through the base member for retention on a knife blade of a folding knife. A set screw may also be retained in the base member. A knife slot is formed in the base member and a portion of the second extended leg to receive a width of a back edge of the knife blade.

14 Claims, 3 Drawing Sheets

FOLDING KNIFE WITH A COMBINATION BOTTLE OPENER AND ACTUATION EXTENSION

BACKGROUND OF THE INVENTION

1. Field of the Invention

The present invention relates generally to folding knives and more specifically to a folding knife with a combination bottle opener and actuation extension, which includes a width similar to that of a typical bottle opener.

2. Discussion of the Prior Art

U.S. Pat. No. 964,558 to Rose discloses a combined knife and bottle opener. China Patent No. 203221521 discloses a multifunctional kitchen knife. U.S. Pat. No. 8,695,138 to Pelton discloses a folding survival knife with integrated tools.

Accordingly, there is a clearly felt need in the art for a folding knife with a combination bottle opener and actuation extension, which includes a width similar to that of a typical bottle opener.

SUMMARY OF THE INVENTION

The present invention provides a folding knife with a combination bottle opener and actuation extension, which includes a width similar to that of a typical bottle opener. The folding knife with a combination bottle opener and actuation extension (knife bottle opener) preferably includes a bottle opening member and a fastener. The bottle opening member includes a base member a first extended leg and a second extended leg. The first extended leg extends from one side of the base member at a top of the base member. The second extended leg extends from the one side of the base member at a bottom of the base member. The second extended leg extends outward and upward from the base member. In an alternative embodiment, an inside surface of the first extended leg, the second extended leg and the base member include a hex shape for receiving a hex driver bit.

A retention hole is formed through the base member for retention on a back edge of a knife blade of a folding knife. A knife slot is formed in the base member and a portion of the second extended leg. The knife slot is sized to receive a width of a back edge of a knife blade. A set screw may also be retained in the base member. A knife blade of a folding knife typically includes an actuation extension. The actuation extension is retained in an actuation hole formed through a width of the knife blade. To install the knife bottle opener, the actuation extension is removed from the knife blade. The back side of the knife blade is inserted into the knife slot. The fastener is inserted through the retention hole in the knife bottle opener and the actuation hole in the knife blade. The fastener may be a rivet; a bolt and threaded nut; or any other suitable fastener.

Accordingly, it is an object of the present invention to provide a folding knife with a combination bottle opener and actuation extension, which includes a width similar to that of a typical bottle opener.

DETAILED DESCRIPTION OF THE PREFERRED EMBODIMENTS

Figure 1:
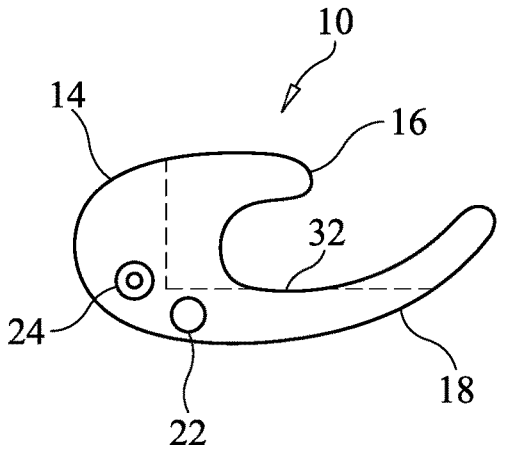
FIG. 1 is a side view of a bottle opening member of a knife bottle opener in accordance with the present invention.
Figure 1A:
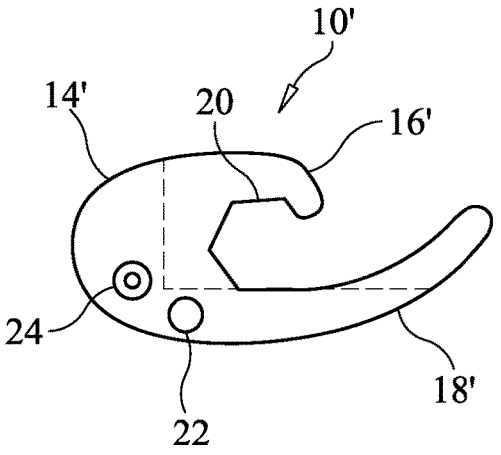
FIG. 1*a* is a side view of an alternative embodiment of a bottle opening member of a knife bottle opener with a hex cavity for receiving a hex tool bit in accordance with the present invention.
Figure 2:
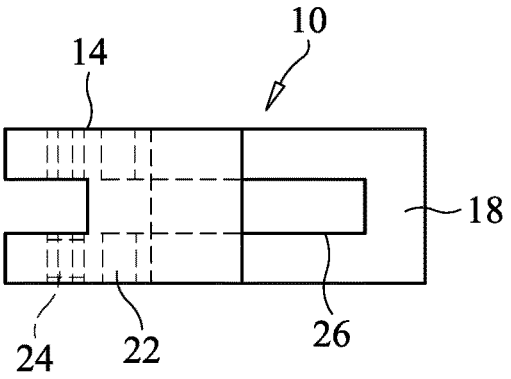
FIG. 2 is a top view of a bottle opening member of a knife bottle opener in accordance with the present invention.
Figure 3:
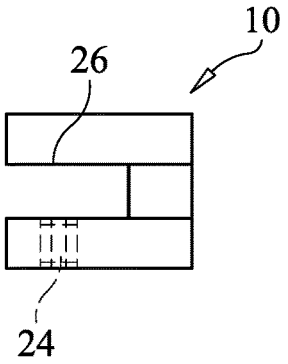
FIG. 3 is an end view of a bottle opening member of a knife bottle opener in accordance with the present invention.
Figure 4:
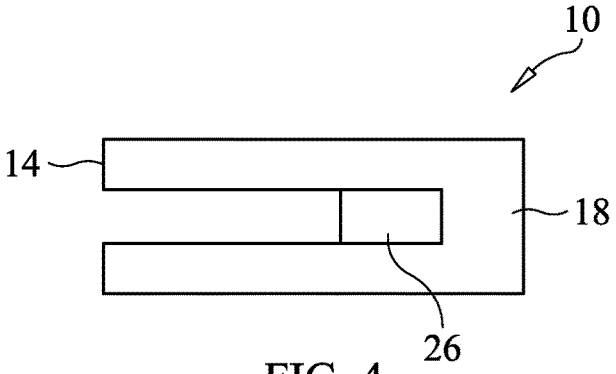
FIG. 4 is a bottom view of a bottle opening member of a knife bottle opener in accordance with the present invention.
Figure 5:
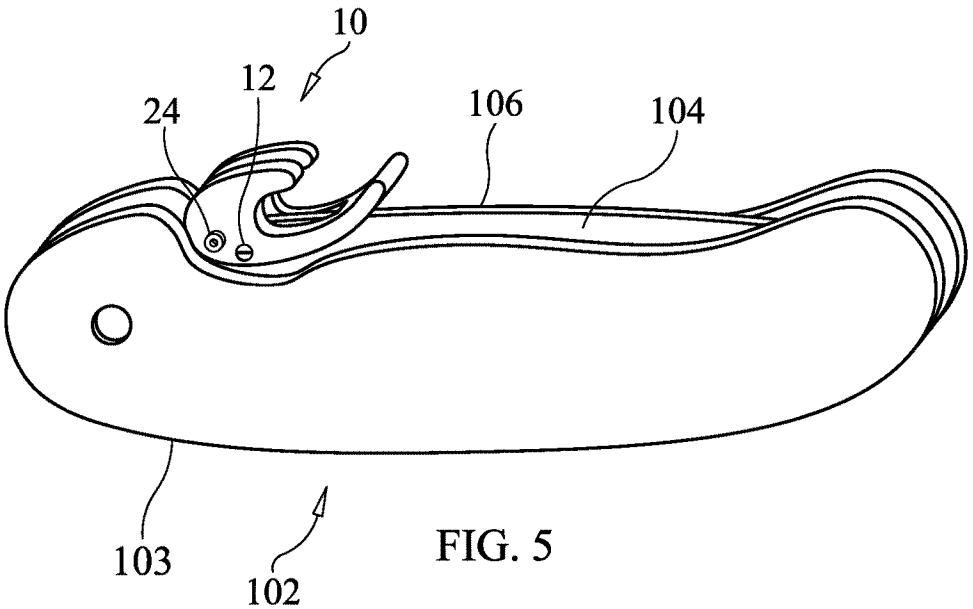
FIG. 5 is a side view of a knife bottle opener attached to a knife blade of a closed folding knife in accordance with the present invention.
Figure 6:
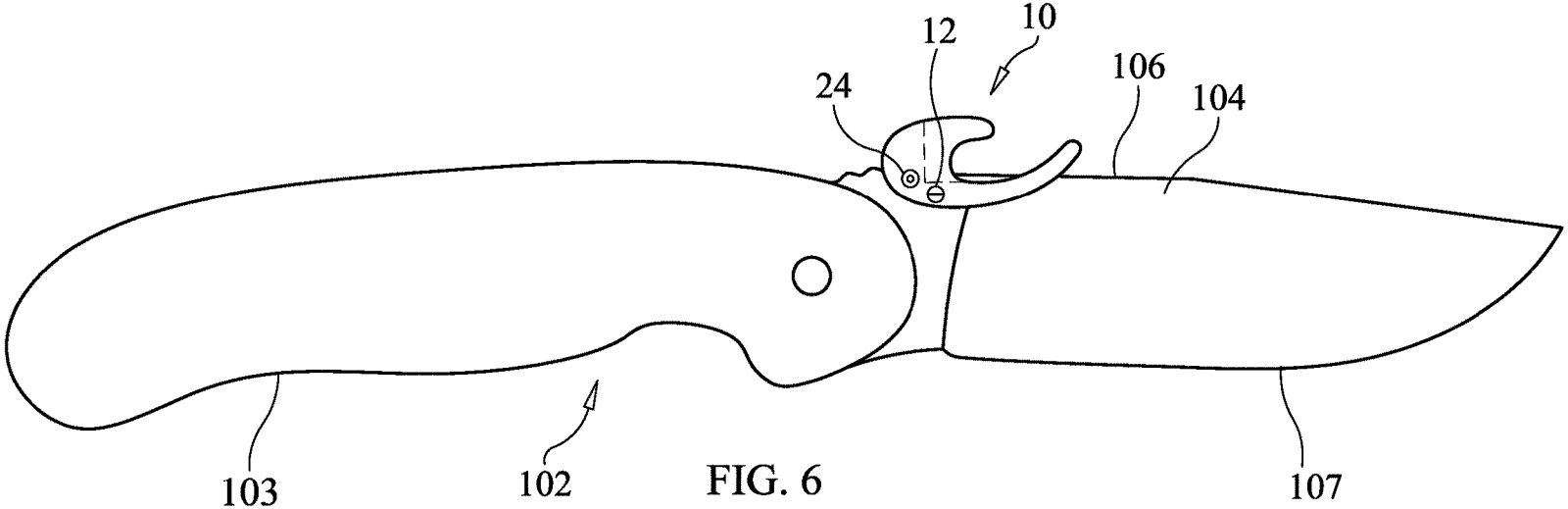
FIG. 6 is a side view of a knife bottle opener attached to a knife blade of an open folding knife in accordance with the present invention.
Figure 7:
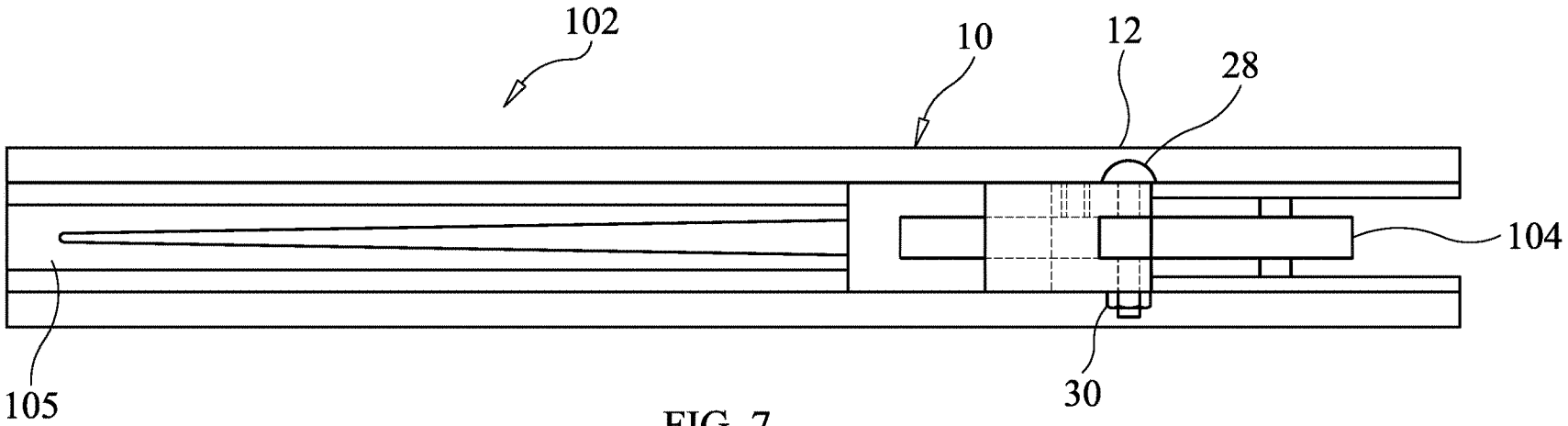
FIG. 7 is a top view of a knife bottle opener attached to a knife blade of a closed folding knife in accordance with the present invention.
Figure 7A:
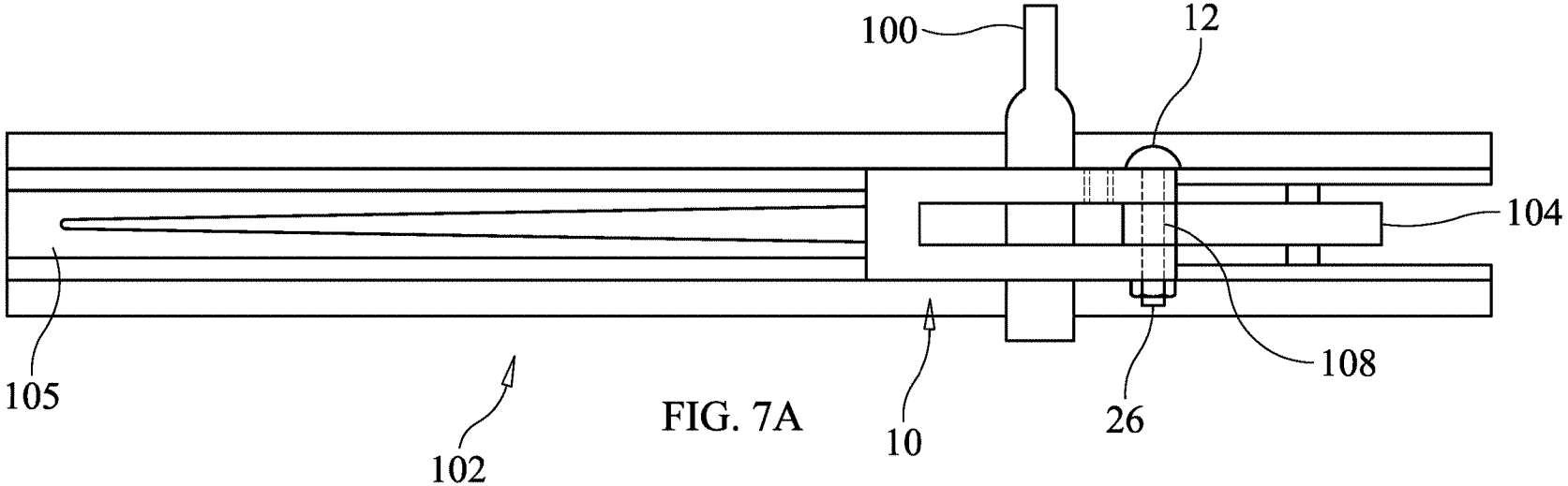
FIG. 7*a* is a top view of an alternative embodiment a knife bottle opener with a hex cavity for receiving a hex tool bit and the knife bottle opener is attached to a knife blade of a closed folding knife in accordance with the present invention.

With reference now to the drawings, and particularly to FIG. 1, there is shown a side view of a bottle opening member 10. With reference to FIGS. 2-7, a knife bottle opener 1 preferably includes the bottle opening member 10 and a fastener 12. The bottle opening member 10 includes a base member 14, a first extended leg 16 and a second extended leg 18. The first extended leg 16 extends from one side of the base member 14 at a top of the base member 14. The second extended leg 18 extends from the one side of the base member 14 at a bottom of the base member 14. The second extended leg 18 extends outward and upward from the base member 14 with a substantially curved profile. The second extended leg 18 is at least twice the length of the first extended leg 16. With reference to FIG. 1*a*, an alternative embodiment of the bottle opening member 10' includes an inside surface of the first extended leg 16', the second extended leg 18' and the base member 14' include a hex shape 20 for receiving a hex driver bit 100.

A retention hole 22 is formed through the base member 14 for retention on a knife blade 104 of a folding knife 102. The folding knife 102 includes a handle 103 and the knife blade 104. One end of the knife blade 104 is pivotally engaged with one end of the handle 103. The handle 103 includes a blade slot 105 for receiving the knife blade 104. The knife blade 104 includes a cutting edge 107 formed on one side thereof. The cutting edge 107 is completely covered by the handle 103 when folded into the blade slot 105. A knife slot 26 is formed in the base member 14 and a portion of the second extended leg 18 to receive the knife blade 104. The knife slot 26 is sized to receive a width of a back edge 106 of the knife blade 104. A set screw 24 may also be retained in the base member 14, 14'. The set screw 24 is tightened against a side of the knife blade 104 to retain the knife bottle opener 1 on the knife blade 104. A knife blade of a folding knife typically includes an actuation extension (not shown). The actuation extension is retained in an actuation hole formed through a width of the knife blade. To install the knife bottle opener 1, the actuation extension is removed from the knife blade 104. The knife blade 104 is inserted into the knife slot 26. The fastener 12 is inserted through the retention hole 22 in the base member 14, 14' and an actuation hole 108 in the knife blade 104. The fastener 12 may be a rivet 26; a threaded bolt 28 and a threaded nut 30;

or any other suitable fastener. An inside surface 32 of the second extended leg 18, 18' is preferably substantially flush with the back edge 106 of the knife blade 104. An end of the first extended leg 16, 16' is placed under an edge of a bottle cap and pivoted, such that an end of the second extended leg 18, 18' contacts a top of the bottle cap to remove the bottle cap from the bottle.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A folding knife with a bottle opener, the folding knife includes a handle and knife blade, one end of the knife blade is pivotally engaged with one end of the handle, the handle includes a blade slot for receiving the knife blade, the knife blade includes a cutting edge formed on one side thereof, the cutting edge is completely covered by the handle when folded into the blade slot, comprising:

a bottle opening member includes a base member, a first extended leg and a second extended leg, said first extended leg extends from one side of said base member at a top of said base member, said second extended leg extends from said one side of said base member at a bottom of said base member, a retention hole is formed through said base member, a knife slot is formed in said base member and a portion of said second extended leg for partially receiving the knife blade, wherein said knife slot has an open end located at said base and a closed end located opposite said base; and a fastener is inserted through said base member and a retention hole formed through an opposing side of the knife blade adjacent the one end thereof, wherein said fastener is secured to said base member, said first and second extended legs are capable of removing a bottle cap from a bottle while said bottle opening member is attached to the knife blade, the cutting edge of knife blade is retained in the blade slot when removing a bottle cap.

2. The folding knife with a bottle opener of claim 1 wherein:

said second extended leg extends outward and upward from said base member.

3. The folding knife with a bottle opener of claim 1 wherein:

said fastener is a rivet, or a threaded screw and a threaded nut.

4. The folding knife with a bottle opener of claim 1 wherein:

a hex opening is formed on an inner surface of said first extended leg, said second extended leg and said base member, said hex opening is sized to receive a hex bit, wherein the cutting edge of the knife blade not be exposed when said bottle opening member is being used.

5. The folding knife with a bottle opener of claim 1 wherein:

a set screw is retained in said base member.

6. A folding knife with a bottle opener, the folding knife includes a handle and knife blade, one end of the knife blade is pivotally engaged with one end of the handle, the handle includes a blade slot for receiving the knife blade, the knife blade includes a cutting edge formed on one side thereof, the cutting edge is completely covered by the handle when folded into the blade slot, comprising:

a bottle opening member includes a base member, a first extended leg and a second extended leg, said first extended leg extends from one side of said base member at a top of said base member, said second extended leg extends from said one side of said base member at a bottom of said base member, said cutting edge is not formed on or between said first or second extended legs, a retention hole is formed through said base member, a knife slot is formed in said base member and a portion of said second extended leg for partially receiving the knife blade, wherein said knife slot has an open end located at said base and a closed end located opposite said base; and a fastener is inserted through said base member and a retention hole formed through an opposing side of the knife blade adjacent the one end thereof, wherein said fastener is secured to said base member, said first and second extended legs are capable of removing a bottle cap from a bottle while said bottle opening member is attached to the knife blade.

7. The folding knife with a bottle opener of claim 6 wherein:

said second extended leg extends outward and upward from said base member.

8. The folding knife with a bottle opener of claim 6 wherein:

said fastener is a rivet, or a threaded screw and a threaded nut.

9. The folding knife with a bottle opener of claim 6 wherein:

a hex opening is formed on an inner surface of said first extended leg, said second extended leg and said base member, said hex opening is sized to receive a hex bit, wherein the cutting edge of the knife blade not be exposed when said bottle opening member is being used.

10. The folding knife with a bottle opener of claim 6 wherein:

a set screw is retained in said base member.

11. A folding knife with a bottle opener, the folding knife includes a handle and knife blade, one end of the knife blade is pivotally engaged with one end of the handle, the handle includes a blade slot for receiving the knife blade, the knife blade includes a cutting edge formed on one side thereof, the cutting edge is completely covered by the handle when folded into the blade slot, comprising:

a bottle opening member includes a base member, a first extended leg and a second extended leg, said first extended leg extends from one side of said base member at a top of said base member, said second extended leg extends from said one side of said base member at a bottom of said base member, said second extended leg is at least twice a length of said first extended leg, a retention hole is formed through said base member, a knife slot is formed in said base member and a portion of said second extended leg for partially receiving the knife blade, wherein said knife slot has an open end located at said base and a closed end located opposite said base; and a fastener is inserted through said base member and a retention hole formed through an opposing side of the knife blade adjacent the one end thereof, wherein said fastener is secured to said base member, said first and second extended legs are capable of removing a bottle cap from a bottle while said bottle opening member is attached to the knife blade.

12. The folding knife with a bottle opener of claim 11 wherein:

said second extended leg extends outward and upward from said base member.

13. The folding knife with a bottle opener of claim 11 wherein:

said fastener is a rivet, or a threaded screw and a threaded nut.

14. The folding knife with a bottle opener of claim 11 wherein:

a hex opening is formed on an inner surface of said first extended leg, said second extended leg and said base member, said hex opening is sized to receive a hex bit, wherein the cutting edge of the knife blade not be exposed when said bottle opening member is being used.

* * * * *